US007997428B2

(12) United States Patent
Goldstein

(10) Patent No.: US 7,997,428 B2
(45) Date of Patent: Aug. 16, 2011

(54) INSIDE WALL MOUNTED HANGING RODS

(75) Inventor: Allan Goldstein, Old Tappan, NJ (US)

(73) Assignee: EMSA Sales Corporation, Old Tappan, NJ (US)

( * ) Notice: Subject to any disclaimer, the term of this patent is extended or adjusted under 35 U.S.C. 154(b) by 249 days.

(21) Appl. No.: 11/734,408

(22) Filed: Apr. 12, 2007

(65) Prior Publication Data

US 2007/0284324 A1 Dec. 13, 2007

Related U.S. Application Data

(60) Provisional application No. 60/744,876, filed on Apr. 14, 2006.

(51) Int. Cl.
*A47H 1/08* (2006.01)

(52) U.S. Cl. ..... 211/105.3; 16/87 R; 16/DIG. 41; 4/558; 4/608; 482/39; 248/251

(58) Field of Classification Search ..... 211/105.1, 211/105.3, 105.4, 87.01, 123, 105.5, 105.6; 16/87 R, 87.2, 415, 444, DIG. 41; 4/608, 4/610, 607, 558; 482/38, 39, 40; 248/251, 248/262, 264

See application file for complete search history.

(56) References Cited

U.S. PATENT DOCUMENTS

| | | | | | |
|---|---|---|---|---|---|
| 1,037,846 | A * | 9/1912 | Anderson | 211/105.3 |
| 1,837,340 | A * | 12/1931 | Schwartz | 211/105.4 |
| 2,200,740 | A * | 5/1940 | Gaudet | 211/105.3 |
| 2,903,141 | A * | 9/1959 | Seewack | 211/105.4 |
| 3,580,397 | A * | 5/1971 | Triplett | 211/105.4 |
| 5,678,703 | A * | 10/1997 | Sawyer | 211/105.1 |
| 6,019,233 | A * | 2/2000 | Yu | 211/87.01 |
| 6,543,629 | B1 * | 4/2003 | Samelson | 211/105.1 |
| 2002/0148796 | A1 * | 10/2002 | Lin | 211/123 |
| 2004/0149094 | A1 * | 8/2004 | Liao | 82/142 |
| 2007/0170134 | A1 * | 7/2007 | Bishop et al. | 211/105.1 |
| 2008/0078018 | A1 * | 4/2008 | Hanley et al. | 4/558 |

* cited by examiner

*Primary Examiner* — Darnell M Jayne
*Assistant Examiner* — Devin Barnett
(74) *Attorney, Agent, or Firm* — Theresa O'Rourke Nugent; Nugent & Smith, LLP

(57) ABSTRACT

A support rod for curtains and the like has telescoping sections the ends of which are threaded for being screwed onto respective receivers mountable on facing walls in axial alignment. The receivers are fixed to the walls by fasteners which are concealed within the bore of at least one of the rod section or its mating receiver. A decorative flange may be mounted between each receiver and its respective rod section.

10 Claims, 6 Drawing Sheets

INSIDE WALL MOUNTED HANGING RODS

BACKGROUND OF THE INVENTION

The present invention is directed to the mounting of rods between facing walls. Such rods are commonly used in living rooms for hanging decorative curtains and draperies, in bath rooms for hanging shower curtains, and in closets for hanging clothing. Such rods of sufficient strength may also be mounted in hallways and alcoves for use in exercise, e.g., chinning rods.

More specifically the present invention provides a secure mounting of the opposite ends of an adjustable rod between opposing walls while maintaining an aesthetically pleasing appearance.

It is know in the art to mount rods between walls for hanging various articles. Tension rods employ two telescoping sections of a rod which are urged axially apart by one or more springs. A device for securing the rod to the walls may be mounted on the ends of the rod, e.g., a rubber pad or a suction cup. Because such rods must rely wholly on friction between their ends and the adjacent walls, they are generally secure enough to support only very light loads.

For greater strength, it is known to support each end of a rod within a seat within a central opening of a flange which is mounted on a wall by multiple screws disposed on the circumference of the flange. It is also known to mount on a wall, beams or blocks which are apertured or notched to receive the end of a rod. The appearance of such mounts with screw or nailed heads visible in an unattractive flange, beam or block can be an eyesore. Moreover, such mounting schemes generally require that the rod be of fixed length carefully cut to the right size as the ends of a telescoping adjustable rod are subject to being withdrawn from their seats, thereby causing the rod to fall to the floor.

SUMMARY OF THE INVENTION

The present invention overcomes the aforementioned shortcomings of prior art inside rod mounting arrangements by providing for simple installation, security, and a pleasing appearance. More particularly the present invention provides a support rod having two telescoping sections slidably connected with respect to one another and sharing a common longitudinal axis, each of the sections having an end comprising a rod threaded connector with an axis, a pair of receivers, each of the receivers having an axial open bore extending between a wall mountable end of the receiver and an opposite rod receiving end of the receiver and having a receiver threaded connector with an axis, the receiver threaded connector being complementary to one of the rod threaded connectors, a fastener for mounting each receiver on a respective one of two facing walls with the receiver axes in horizontal alignment, one of the rod threaded connector and the receiver threaded connector being a male connector with its threads facing away from its axis, the other of the rod threaded connector and the receiver threaded connector being a female connector having a hollow bore in which its threads face toward its axis, each fastener for mounting each receiver being at least partially disposed within the bore of its respective receiver for being hidden from view when one of the rod threaded connectors is mated with the receiver threaded connector of the receiver.

DESCRIPTION OF THE PREFERRED EMBODIMENT

Figure 1:
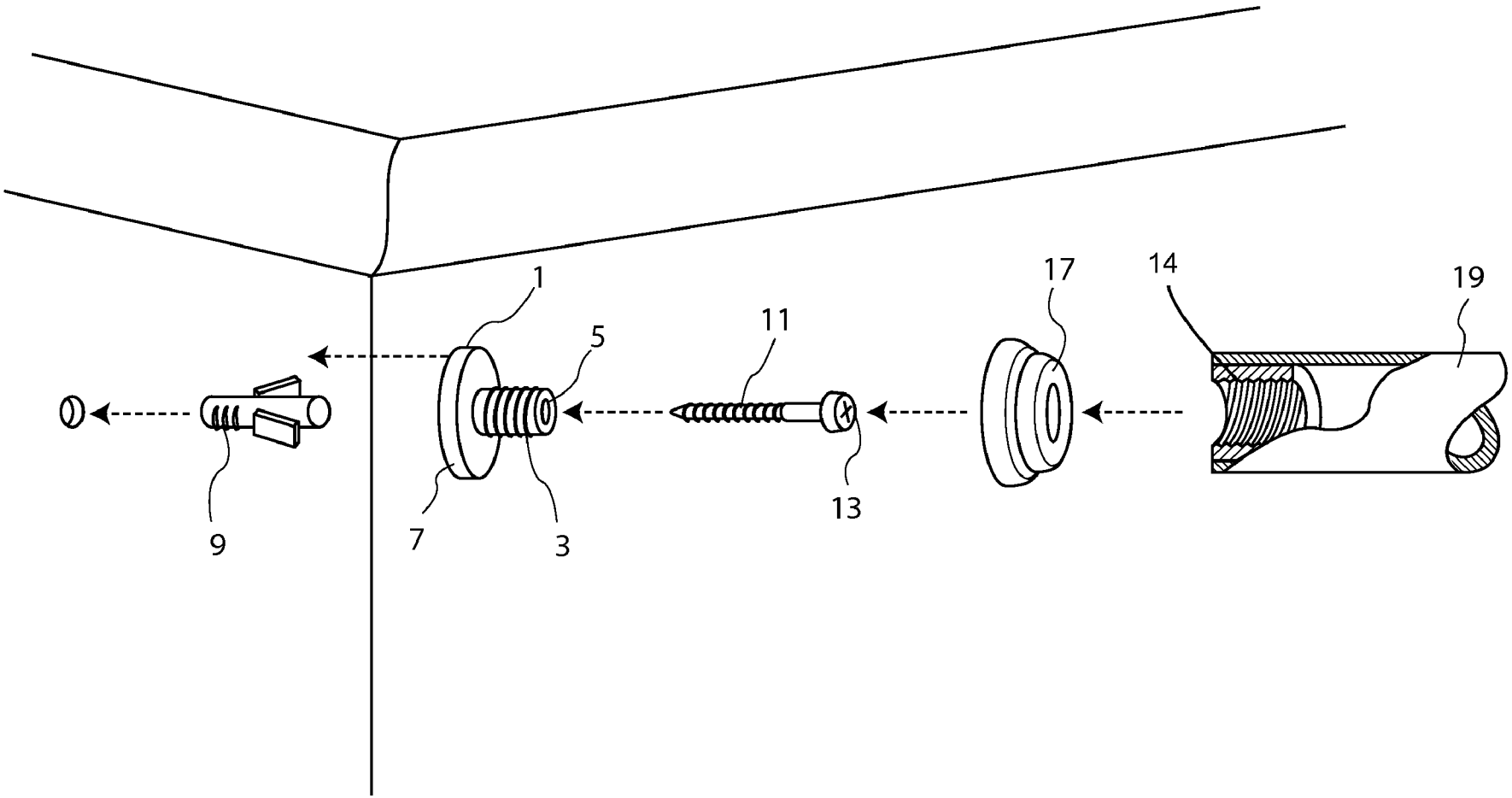
FIG. 1 is an exploded perspective view of a portion of a first embodiment of the invention.

Referring now to FIG. 1 of the drawings, there is shown a receiver 1 having a threaded connector in the form of a stud 3 with male threads and a central axial open bore 5 extending between a wall mountable end of the receiver 1 and an opposite rod receiving end of the receiver 1 in communication with a central aperture 6 in a circular flange 7 from which the stud 3 extends. An optional anchor 9 adapted to be driven through a hole drilled in a wall is provided for receiving the shank of a fastener which, in the preferred embodiment of the invention, is a screw 11, but which can also be a nail or other fastener having a shank and a head as will be known to those skilled in the art. The shank of the screw 11 is passed through the bore 5 and aperture with the end of the screw 11 distal from its shank penetrating the wall. Where the axis of the receiver 1 is in alignment with a stud in the wall, the anchor 9 need not be used and the screw 11 may be driven through the wall into the wall stud.

Figure 2:
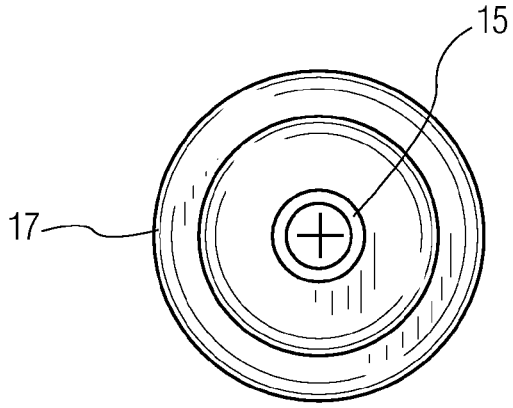
FIG. 2 is an end view of a component of the first embodiment of invention shown in FIG. 1.

The head 13 of the screw can have a diameter smaller than the diameter of the bore 5 in which case the underside of the screw head 13 engages a circular seat in the form of a circular apertured shoulder 15 (se FIG. 2) within the bore 5 proximate the flange 7 at the wall mountable end of the receiver when the screw is fully tightened. Alternatively, as shown in FIG. 3, the head 13 of the screw 11 can have a diameter approximately equal to the outer diameter of the stud 3 and less than the diameter of the bore 5 for allowing a threaded connector in the form of a nut 14 to be passed over the head 13 and threaded onto the stud 3 when the screw 11 is fully tightened to secure the receiver 1 to the wall.

The nut 14, which has a female thread facing toward its axis, is fixedly mounted, e.g., by an interference fit, within an outer end of a section 19 of a telescoping rod or pipe having two or more sections slidably connected with respect to one another and sharing a common longitudinal axis, for enabling each section to be fastened to a receiver 1 by rotation about a mutual axis of the section 19 and receiver 1. Instead of providing a nut 14, the inner bore of the rod section may be provided with female threads facing inwardly toward the axis of the rod section, complementary to the outward facing male threads on the outer surface of the stud 3.

Figure 4:
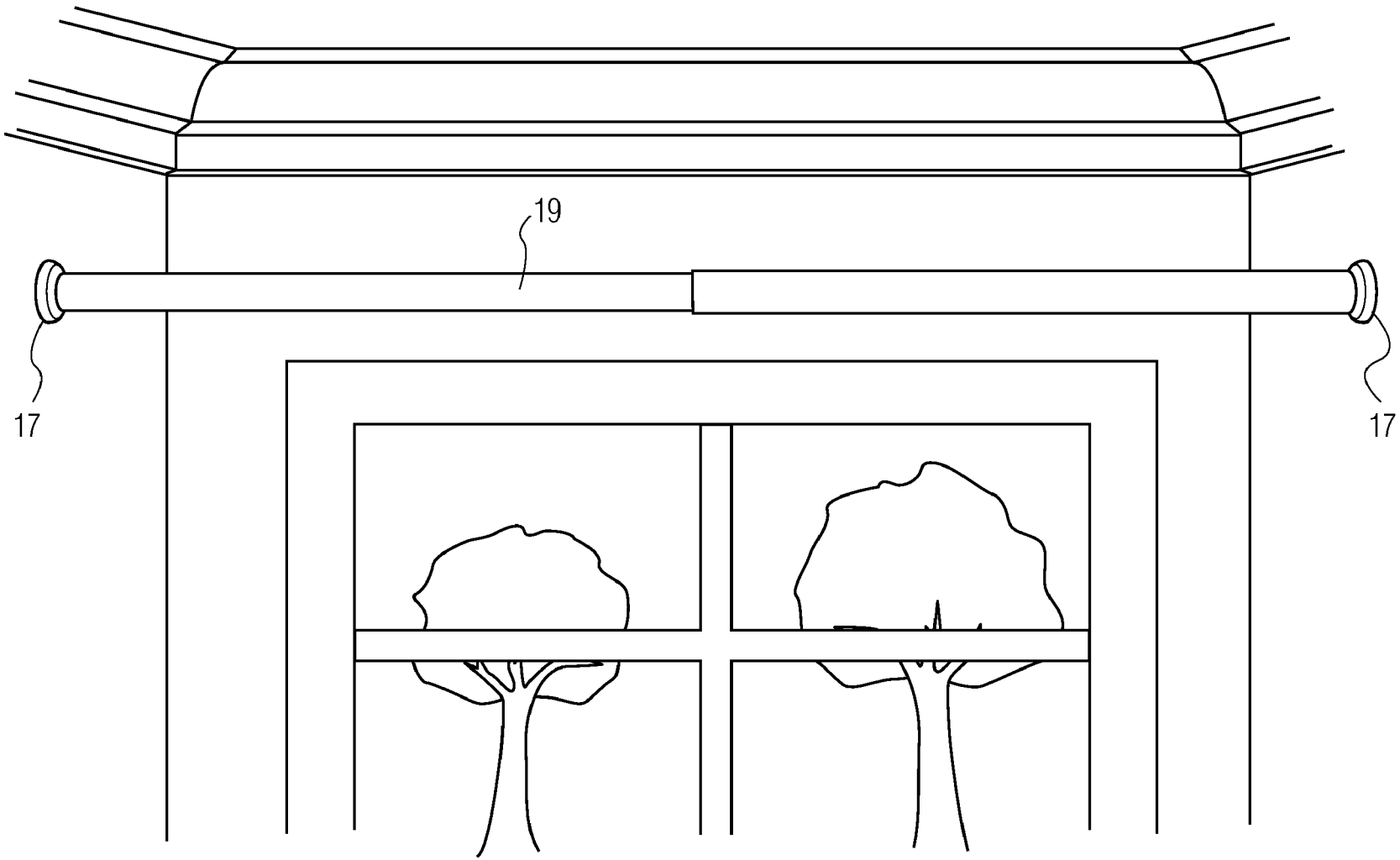
FIG. 4 is an environmental perspective view of the first embodiment of the invention.

In use, two receivers 1 are mounted as described above, each on a respective one of two facing walls with the axes of the receivers 1 horizontal alignment, and with their threaded studs projecting toward one another. A telescoping rod prepared as described above has each of its end sections threaded onto a respective one of the studs for secure attachment to the receivers as seen in FIG. 4.

Figure 3:
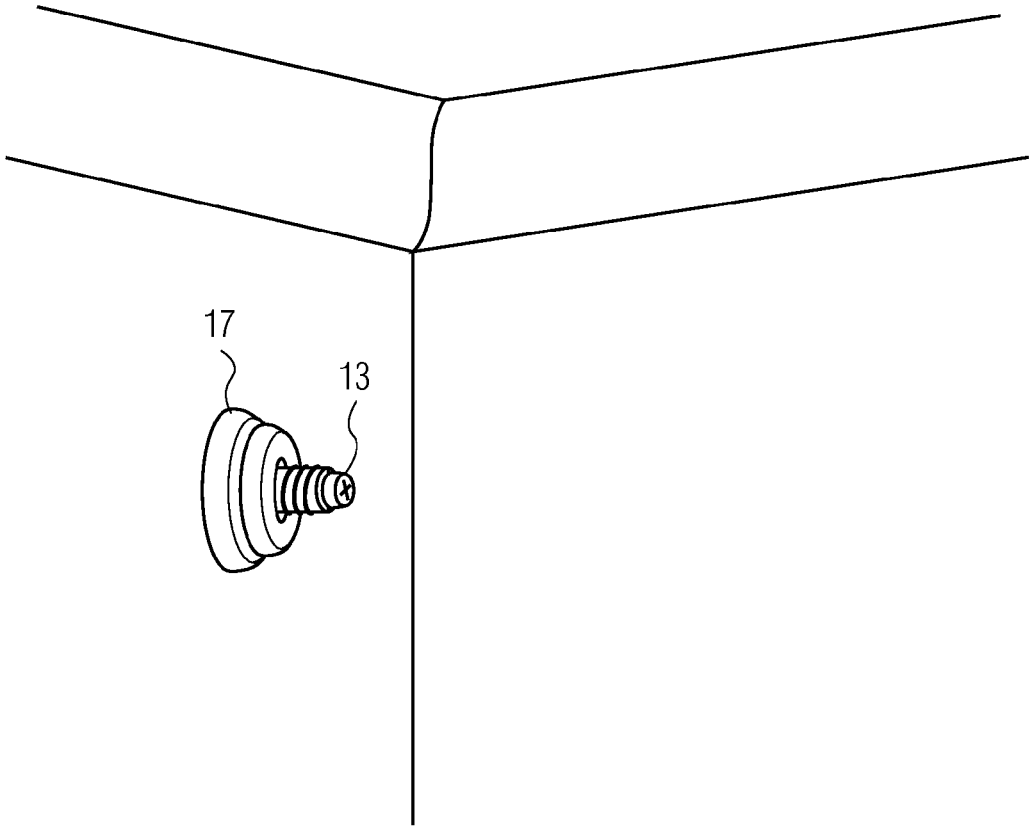
FIG. 3 is an environmental perspective view of the component of the first embodiment of the invention shown in FIG. 1.

In order to enhance the appearance at the interface of the rod with the receiver, a decorative collar 17 with a central aperture can be placed over the stud 3 as shown in FIGS. 1 and 3. As the rod section 19 is rotated onto the stud 3, the end of the section 19 engages the collar 17 thereby securing the rod section 19 and collar 17 on the receiver 1 when the rod threaded connector nut 14 and receiver threaded connector stud 3 are mated by threading the stud 3 into the nut 14. The collar 17 may be formed from a semi-resilient shape-retaining metal, plastic, or similar material thereby increasing friction with the end of the rod section 19 in the manner of a lock washer for preventing loosening of the connection between the rod section 19 and receiver 1. Referring to FIGS. 1-4, collar 17 may have two axially spaced apart tapering portions separated from each other by a stepped surface, one of the two tapering portions being wider than another of the two tapering portions.

Figure 5:
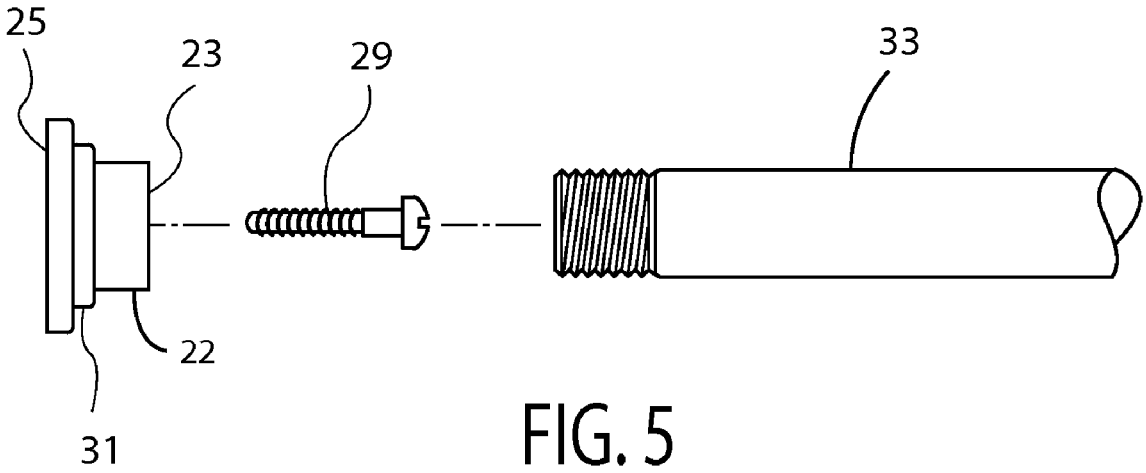
FIG. 5 is an exploded side elevation view of a portion of a second embodiment of the invention.
Figure 6:
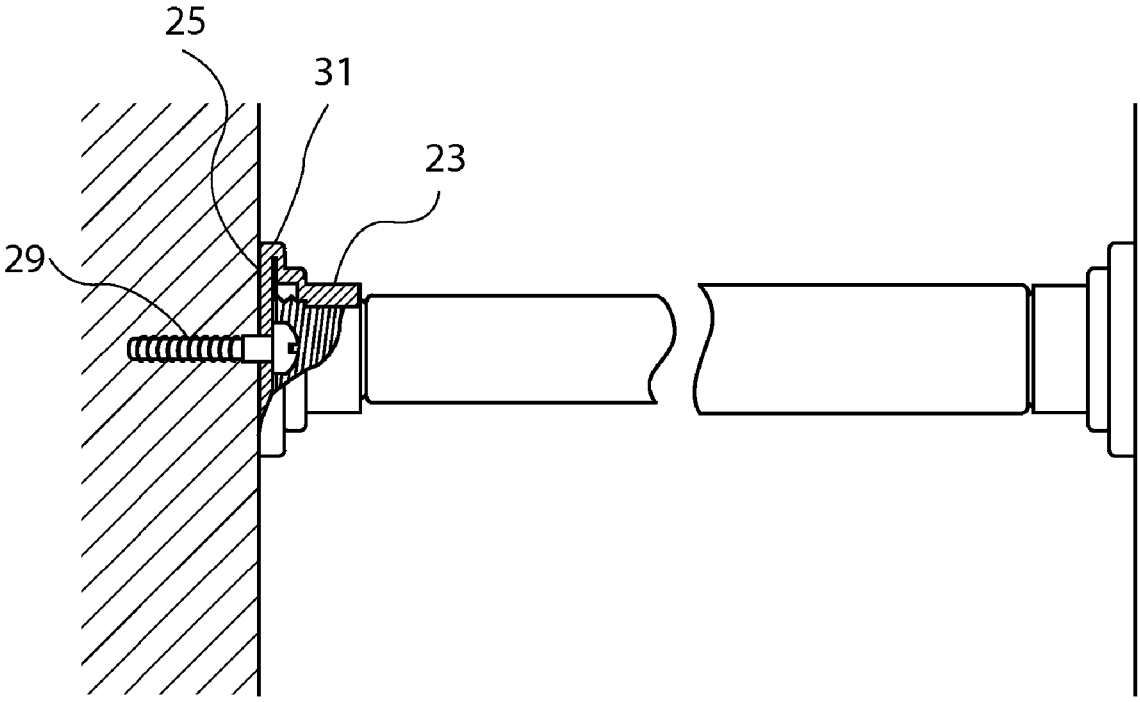
FIG. 6 is an assembled side elevation view of the portion of the second embodiment of the invention shown in FIG. 5.

Referring to FIGS. 5 and 6, in an alternative embodiment of the invention, instead of a threaded stud, a receiver 25 can be provided with a nipple 22 having a central threaded axial bore 23 in communication with a central aperture in a circular flange from which the nipple 22 extends. Again, an optional anchor adapted to be driven through a hole drilled in a wall can be provided for receiving a screw passed through the bore and aperture. The screw may be driven through the wall into a wooden stud.

The head of a screw 29 has a diameter smaller than the diameter of the bore 23 in which case the underside of the head of the screw 29 engages a circular seat at the end of the bore 23 proximate the flange 31 when the screw 29 is fully tightened.

Each outer end of an outer section of a telescoping rod or pipe 33 having two or more sections is threaded on its outer cylindrical wall for enabling the end of the section to be threaded into the bore of the receiver 25 whereby the section 33 can be fastened to the receiver 25 by rotation about a mutual axis of the section 33 and receiver 25. The outer circumference of the nipple 22 may be given a stepped configuration or other decorative or aesthetically pleasing form.

Figure 7:
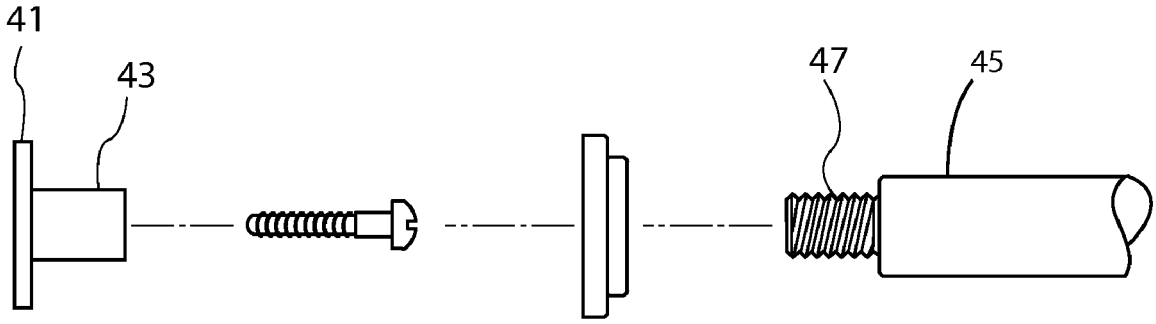
FIG. 7 is an exploded side elevation view of a portion of a third embodiment of the invention.
Figure 8:
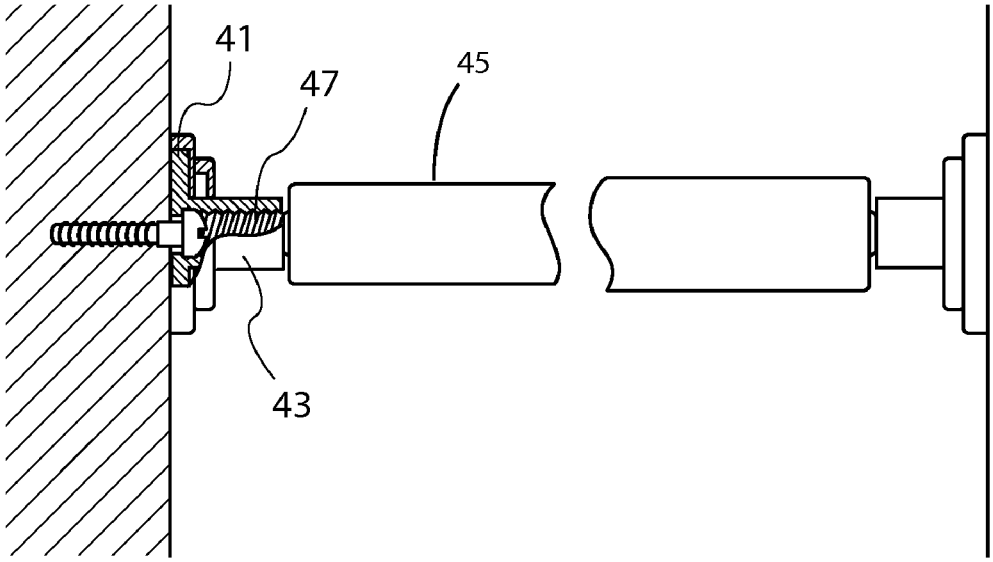
FIG. 8 is an assembled side elevation view of the portion of the third embodiment of the invention shown in FIG. 7.

Referring now to FIGS. 7 and 8, according to still a further embodiment of the invention, a receiver 41 can be provided with a nipple 43 having a central threaded axial bore in communication with a central aperture in a circular flange from which the nipple extends and attached to a wall as explained above.

Each outer section 45 of a telescoping rod or pipe having two or more sections can be provided with a fixed threaded stud 47 extending beyond its outer end for being received within the bore in the nipple of the receiver 41. When the threaded stud 47 is fully threaded into the bore in the nipple 43, the end of the rod section 45 engages with the end of the nipple distal from the flange as shown in FIG. 8. By making the outer diameters of the rod section 45 and nipple equal 43, and squaring the end surfaces of the rod section 45 and nipple 43, the rod and nipple 43 may appear to be a unitary continuous structure.

Instead of mounting the receiver on the wall with a stud or nipple extending into the room in which the rod is to be mounted, the receiver may be mounted with the stud or nipple extending through the wall into the room.

Figure 9:
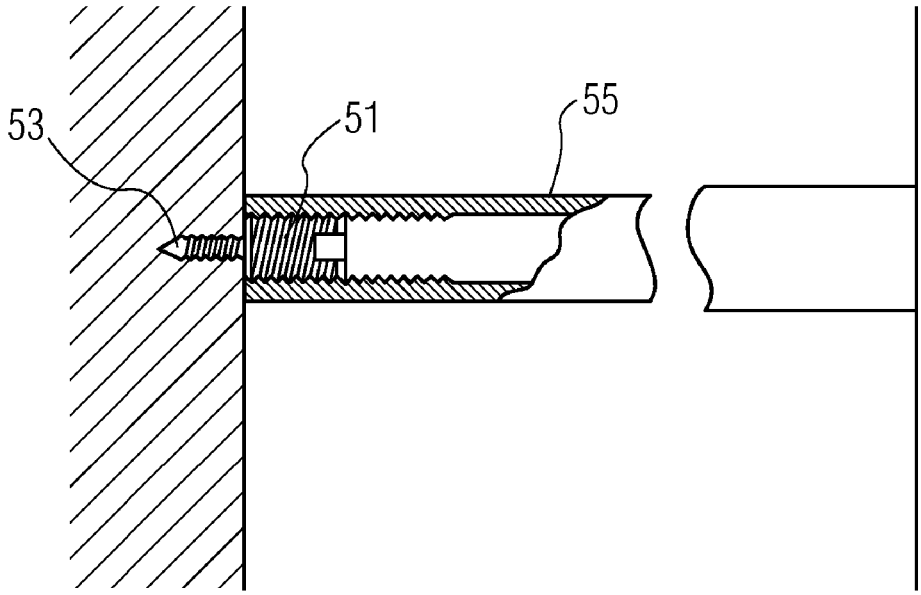
FIG. 9 is a side sectional elevation view in partial section illustrating a fourth embodiment of the invention.

As shown in FIG. 9, a threaded stud 51 having an extending shank 53 is preferably threaded to form a screw with the stud 51 forming the head of the screw. The screw 53 is driven into the wall with the stud 51 extending into the room. A rod section 55 having a nut (not shown) fixedly mounted within its bore, or a bore which is threaded, as shown in FIG. 9, can be mounted on the stud by rotating the rod section 55 to mate the rod section 55 and receiver stud 51 until the end of the rod section 55 engages the surface of the wall, thereby rendering the receiver entirely invisible and providing a clean look with the rod extending fully between opposite walls.

Figure 10:
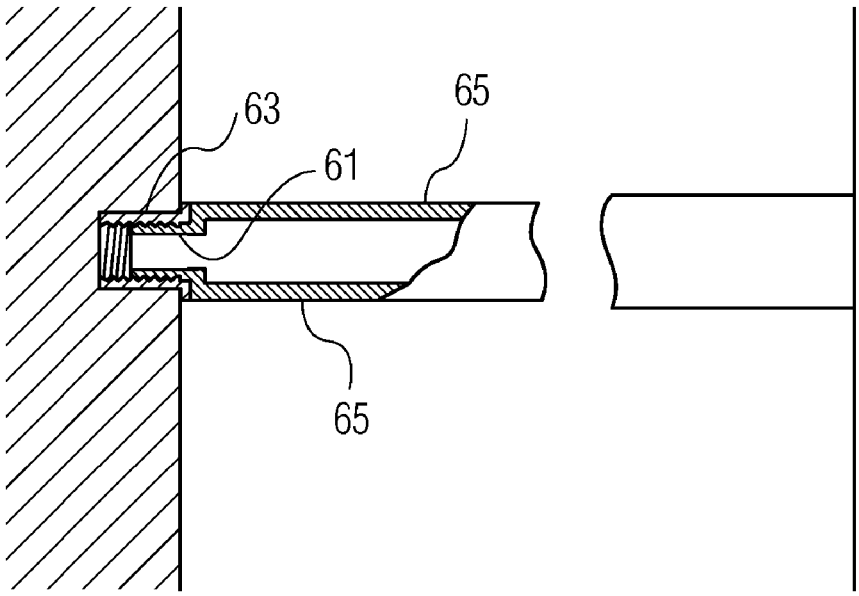
FIG. 10 is a side sectional elevation view in partial section illustrating a fifth embodiment of the invention.

FIG. 10 shows a variation of the arrangement shown in FIG. 10 wherein the cylindrical nipple of a receiver 61 can be threaded on its outer wall 63 for being received in an anchor or a hole drilled through the wall into a wall stud, and threaded on its interior for receiving threads on the end of a rod section 65, i.e., either on the outer wall of the rod section, or on a stud fixedly mounted on and extending from the end of the rod section. The nipple may extend from a flange which has a diameter less than or equal to the diameter of the rod where a stud is mounted on the rod, or only slightly greater than the diameter of the rod where the outer wall of the rod section is threaded to make the rod appear to be mounted directly on the wall.

It is to be appreciated that other and further modifications and variations may be made to the embodiments herein disclosed without departing from the spirit and scope of the invention.

What is claimed is:

1. A support rod comprising:

a left fastener, a right fastener, a left receiver, a right receiver, a left collar, a right collar, a left tubular rod section and a right tubular rod section, all having a common axis, said left fastener being adapted to penetrate a surface of a left wall for being mounted partially within said left wall and extending therefrom with said common axis orthogonal to said surface of said left wall, said right fastener being adapted to penetrate a surface of a right wall, in spaces, facing, parallel relationship to said surface of said left wall, for being mounted partially within said right wall and extending therefrom, said left receiver having an axial open bore extending between a wall mountable end of said left receiver affixed to said left fastener and an opposite rod receiving end of said left receiver, said rod receiving end of said left receiver comprising a left receiver threaded connector having threads circumscribing said common axis, said right receiver having an axial open bore extending between a wall mountable end of said right receiver affixed to said right fastener and an opposite rod receiving end of said right receiver, said rod receiving end of said right receiver comprising a right receiver threaded connector having threads circumscribing said common axis, said left tubular rod section having a left threaded end with threads circumscribing said common axis and an opposite end, said right tubular rod section having a right threaded end with threads circumscribing said common axis and an opposite end, said opposite end of one of said left tubular rod section and said right tubular rod section being slidably mounted within said opposite end of the other of said left tubular rod section and said right tubular rod section whereby said left tubular rod section and said right tubular rod section are in telescoping relationship, one of said left threaded end of said left tubular rod section and said left receiver threaded connector being a male connector with its threads facing away from said common axis, and the other of said left threaded end of said left tubular rod section and said left receiver threaded connector being a female connector in which its threads face toward said axis, one of said right threaded end of said right tubular rod section and said right receiver threaded connector being a male connector with its threads facing away from said common axis, and the other of said right threaded end of said right tubular rod section and said right receiver threaded connector being a female connector in which its threads face toward said axis, said left tubular rod section being rotatable about said common axis with respect to said left receiver for threading said left tubular rod section and said left receiver together, said left collar having an aperture that receives said left receiver threaded connector, said left tubular rod section engaging a front face of said left collar and retaining said left collar on said left receiver as said left threaded end of said left tubular rod section and said left receiver threaded connector are mated and wherein said front face of the left collar contacts an end of said left tubular rod section and said left collar covers said left receiver such that when assembled the left receiver is not visible, said right collar having an aperture that receives said right receiver threaded connector, said right tubular rod section engaging a front face of said right collar and retaining said right collar on said right receiver as said right tubular rod section and said right receiver threaded connector are mated and wherein said front face of the right collar contacts an end of said right tubular rod section and covers said right receiver such that when assembled the right receiver is not visible, and said right tubular rod section being rotatable about said common axis with respect to said right receiver for threading said right tubular rod section and said right receiver together, said left tubular rod section and said right tubular rod section telescoping away from one another as said left tubular rod section is threaded onto said left receiver and said right tubular rod section is threaded onto said right receiver for securing said support rod to said left wall and said right wall, and said left tubular rod section and said right tubular rod section telescoping toward one another as said left tubular rod section is threaded off of said left receiver and said right tubular rod section is threaded off of said right receiver for releasing said support rod from said left wall and said right wall.

2. A support rod according to claim 1 wherein said left threaded end of said left tubular rod section has an axial bore, and said left fastener comprises a shank and a head having a diameter larger than a diameter of said shank, said diameter of said shank being less than a diameter of said bore of said left receiver for enabling said shank to be received within the bore of said left receiver with one end extending therefrom into said wall, and said head has a diameter greater than the smallest diameter of the bore of the left receiver for securing said left receiver on said left fastener, said left fastener being concealed by said left tubular rod section when said left tubular rod section and said left receiver are mated together.

3. A support rod according to claim 2 wherein said left fastener comprises a screw.

4. A support rod according to claim 2 wherein said left fastener comprises a nail.

5. A support rod according to claim 2 further comprising a shoulder with an aperture within said bore of said left receiver for reducing the diameter of said bore, said head having a diameter less than the diameter of said bore at said rod receiving end of said left receiver and greater than a diameter of said aperture of said shoulder whereby said head can be received within a length of said bore proximate the rod receiving end of said left receiver and can engage said shoulder when said shank penetrates said wall for maintaining said left receiver on said wall.

6. A support rod according to claim 1 wherein said left threaded end of said left tubular rod section comprises a female connector in which its threads face toward said common axis, and said left receiver threaded connector comprises a male connector with threads that face away from said common axis.

7. A support rod according to claim 1 wherein said left threaded end of said left tubular rod section comprises a nut seated in an end of said left tubular rod section.

8. A support rod according to claim 1 wherein said left threaded end of said left tubular rod section comprises a threaded length of said left tubular rod section.

9. A support rod according to claim 1 wherein said left and right collars are each formed from a semi-resilient shape-retaining material that increases friction with an end of an associated one of the right and left tubular rod sections to prevent loosening of respective connections between the associated right and left tubular rod sections and associated right and left receivers.

10. A support rod according to claim 1 wherein said left and right collars each have two axially spaced apart tapering portions separated from each other by a stepped surface, one of the two tapering portions being wider than another of the two tapering portions.

* * * * *